US005289943A

United States Patent [19]

Powell

[11] Patent Number: 5,289,943

[45] Date of Patent: Mar. 1, 1994

[54] HOLDER FOR DISPENSING CANS FROM A MULTI-CAN CARTON

[76] Inventor: Philip M. Powell, 7508 N. 50 East, Fortville, Ind. 56040

[21] Appl. No.: 870,954

[22] Filed: Apr. 20, 1992

[51] Int. Cl.[5] ..... B65G 59/00

[52] U.S. Cl. ..... 221/67; 221/282; 229/104

[58] Field of Search ..... 221/67, 281, 282; 211/59.2; 312/45; 229/104, 242; 206/45.21, 45.26

[56] References Cited

U.S. PATENT DOCUMENTS

| | | | |
|---|---|---|---|
| 2,455,706 | 12/1948 | Shaw | 229/104 |
| 3,178,242 | 4/1965 | Ellis et al. | 221/67 |
| 4,030,596 | 6/1977 | Snyder | 229/104 |

*Primary Examiner*—D. Glenn Dayoan

*Assistant Examiner*—Kenneth Noland

*Attorney, Agent, or Firm*—H. John Barnett

[57] ABSTRACT

A gravity feed dispensing holder which is adapted to receive and dispense cans directly from the open end of a multi-can carton. The open end of the multi-can carton fits into the holder which supports the carton on its side so the long axes of the cans are horizontal and at right angles to the direction of movement of the cans toward the open end of the carton. The holder tilts the carton towards its open end to cause gravity flow of the cans toward the open end of the carton into an outer extension of the holder. The holder substantially surrounds the bottom side, the open end and the lower front portion of the top and bottom of the carton. The outer extension of the holder has an upwardly facing opening from which the cans are successively removed. Gravity feed of the cans confined in the carton causes them to roll towards the opening for dispensing.

5 Claims, 2 Drawing Sheets

FIG 2
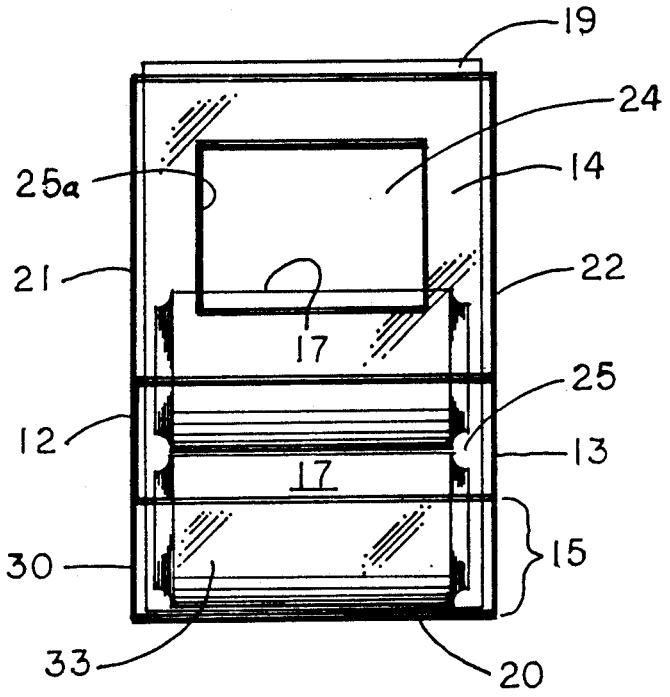
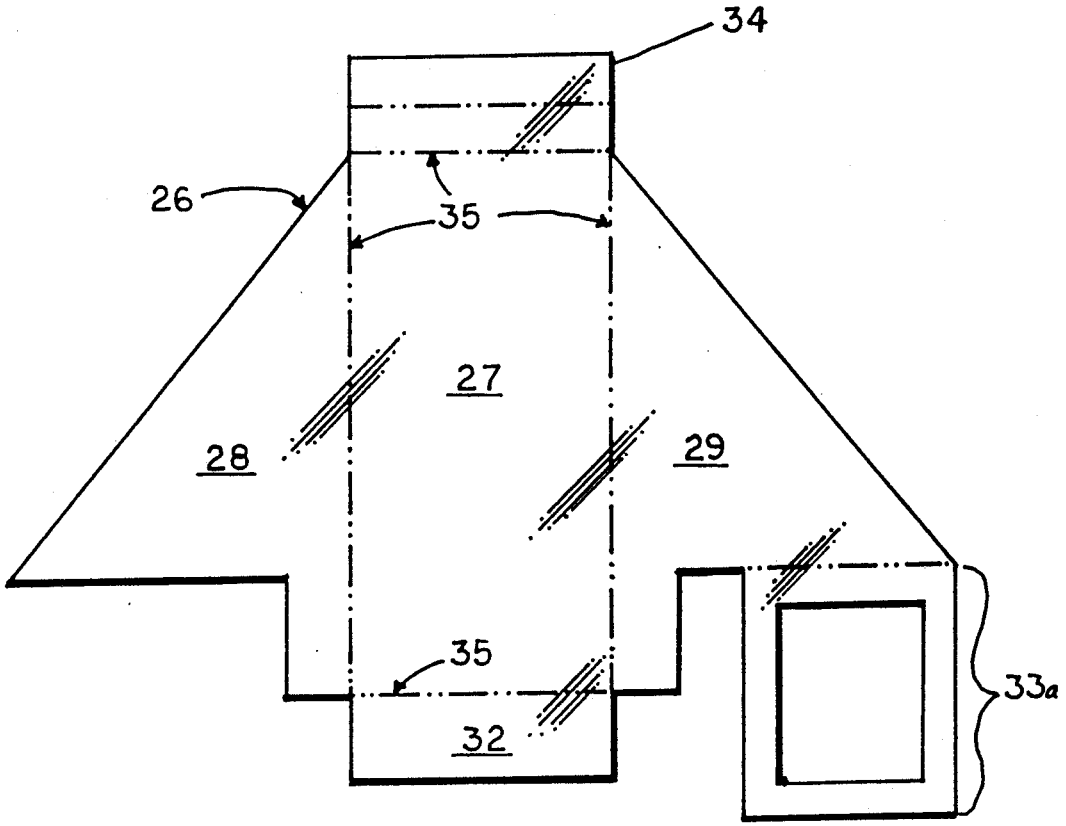
FIG 3

HOLDER FOR DISPENSING CANS FROM A MULTI-CAN CARTON

BACKGROUND OF THE INVENTION

1. Field of the Invention

This invention relates to gravity-feed dispensers for cans, more particularly, beverage cans. Such dispensers are usually placed in refrigerators to provide ready access to already cooled beverages.

All of the dispensers known to applicant include tracks or guide ramps for moving individual cans toward a dispenser access opening. The subject device has no built-in tracks or guide ramps, but relies solely on the downwardly tilted bottom side of the multi-can carton and the top, bottom and side walls of the carton to guide the cans towards the access opening of the holder adjacent the open end of the carton.

2. Description of the Related Art

U.S. Pat. No. 3,805,964 describes a storage and dispensing bin for beverage containers which snap-fits into a refrigerator below a shelf. The individual containers must be removed from their factory carton and put into the bin one-by-one. U.S. Pat. No. 4,998,628 is directed to a dispensing bin for bottles and cans. The bottles or cans must be placed in the bin individually, and the rack unit comprises a box-like exterior frame having a pair of rigid side walls and includes upper and lower ramp-like shelves disposed within the rack which support the beverage containers.

Acme International, Inc., Newark, N.J. presently sells a gravity-feed, space-saving refrigerator can dispenser which rests on a refrigerator shelf. The Acme dispenser is similar to other known dispensers in that the individual cans must be loaded into the dispenser one at a time.

U.S. Pat. Nos. 4,287,992: 4,763,963; 4,785,945; and 4,911,309 all describe types of gravity-feed dispensers for cylindrical containers. U.S. Pat. No. 4,958,739 discloses a gravity-feed shelf for dispensing packaged goods. All of the above dispensers must be stocked one container at a time. This invention eliminates the time-consuming step of individual can loading.

BRIEF SUMMARY OF THE INVENTION

This invention is directed to a simple holder for dispensing cans by gravity-feed directly from a multi-can carton without the step of first removing the cans from the carton and loading them individually into the holder. The holder surrounds an open end, one side, and part of the top and bottom of the carton which is disposed on its side so the cans are on their horizontal axes and are free to roll in the carton. The holder includes a base which tilts the carton toward its open end. The base has an extension with an upward access opening just outward from the open end of the carton to receive and dispense single cans successively as they are gravity fed from the lower open end of the carton.

This invention avoids the extra handling otherwise required by the dispensers of the prior art which remove the cans from their cartons and load them individually into the dispensers. applicant's holder utilizes the multi-can carton in which the cans are shipped as the guide means for guiding the cans to the dispenser opening. Although the holder is primarily useful for holding and dispensing beverage cans from a refrigerator, it can also be used to dispense directly from cartons of canned goods in stores and supermarkets, as well as service stations.

BRIEF DESCRIPTION OF THE DRAWINGS

FIG. 2 is a schematic front elevation with some parts broken away showing the dispenser and carton of FIG. 1;

FIG. 3 is a plan view with fold lines shown in phantom of a one piece pattern from which the holder can be formed.

DETAILED DESCRIPTION OF THE INVENTION

Figure 1:
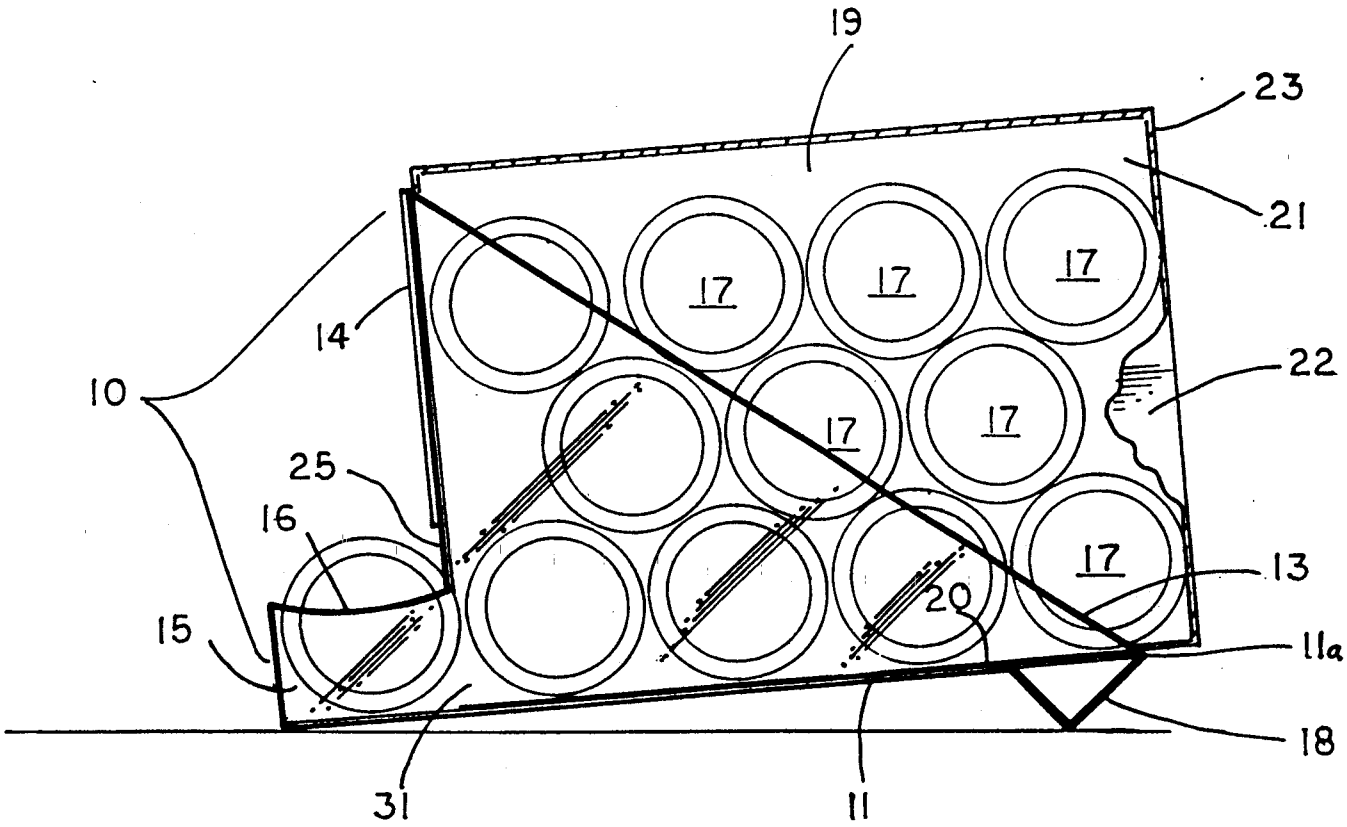
FIG. 1 of the drawings is a schematic side elevation with some parts broken away showing the holder with a multi-pack carton disposed therein.

As seen in the drawings, a holder 10 comprises a base 11, side walls 12 and 13, front wall 14 and dispenser pocket 15. The dispenser pocket 15 has an upwardly facing opening 16 from which cans 17 can be removed. The opposite end **11*a* of the base 11 includes a downward extension 18 for tilting the base 11 and carton 19 towards the dispenser pocket 15**.

Carton 19 is disposed in the holder 10 on its side so that the cans 17 are horizontal and will roll towards the upper opening 16 in the dispenser pocket 15 by gravity. The cans 17 are confined by bottom side wall 20, top and bottom walls 21 and 22, respectively, and the closed end wall 23 of the carton 19. Open end 24 of the carton 19 is disposed against the front wall 14 of the holder 10. The front wall 14 does not extend to the base 11, but has an opening 25 adjacent base 11 communicating with the dispenser pocket 15 to allow gravity flow of successive cans 17 from the tilted carton 19 into the pocket 15 for removal.

In addition, the front wall 14 has a cut-out opening **25*a* to provide hand access into the open end 24 of the carton 19 to free up the cans 17 if they jam together and need a little push to resume gravity feed into the dispenser pocket 15. During normal operation, the downward tilt of the base 11 provides enough height differential between the closed end wall 23 and the open end 24 of the carton 19 to automatically feed successive cans 17 into the dispenser pocket 15 as the previous can 17** is removed.

FABRICATION

The holder 10 can be made from many materials, including thermoplastic and thermosetting resins & polymers, wood, press board or metal, and combinations of these. The presently contemplated material is a polycarbonatec resin material, marketed under the trademark LEXAN by General Electric Company, Inc.

FIG. 3 of the drawings shows a one-piece pattern 26 which is cut out from a sheet of thermoplastic acrylic resin. Section 27 will become base 11 when the pattern 26 is heated and formed. The side tabs 28 and 29 will become the side walls 12 and 13, respectively, and the sides 30 and 31 of the pocket 15. Lower tab 32 becomes the front wall 33 of the pocket 15.

The lower extension **33*a* of side tab 29 becomes the upper front wall 14 when the forming steps are completed. Finally, the upper tab 34 is folded downwardly from the section 27 to become the downward extension 18 which tilts the base 11 towards the dispenser pocket 15 in the completely formed holder 10**.

Localized heating along the fold lines 35 prepares each part of the pattern 26 for folding. Side tabs 28 and 29 may be first folded to a 90 deg. angle, and then the lower tab 32 may be folded up as far as needed to meet the edges of the side tabs 28 and 29. After the side tabs 28 and 29 are in their final positions, the lower extension 33 of side tab 13 is heated and folded across the front to define front wall 14. Finally, upper tab 34 of pattern 26 is first folded 135 deg. at its midpoint, and then again folded 135 deg. at its base to define the downward extension 18.

As can best be seen in FIGS. 1 and 2, the dimensions of the holder 10 are determined by the size of the particular multi-pack carton 19. The base 11 of the holder 10 should be about the same length as the side of the carton 19 and the greatest height of the side walls 12 and 13 adjacent the front wall 14 should be about the same height as the open end 24 of the carton 19.

The above fabrication method is only one of the many possible methods of fabrication. If the holder 10 is mass produced, it can be made by injection molding, or it can be pattern-cut and folded in a substantially continuous operation. The appearance of the holder 10 can be modified for cost savings, also. For example, the Base 11 and the side walls 12 and 13 do not have to be solid sheets if a saving in manufacturing costs can be realized by cutting out nonessential portions of these parts. The essential function of the holder 10 is to support a multi-pack carton 19 of cans 17 on its side with the open end 24 of the carton 19 disposed against the front wall 14 of the holder 10 so that cans 17 in the carton 19 will roll towards the dispenser pocket 15 where successive cans 17 can be removed by way of the upward facing opening 16.

What is claimed is:

1. A re-usable gravity-feed holder adapted to fit around and support a multi-pack carton of cylindrical containers for dispensing individual cylindrical containers directly from an open end of the carton comprising:

an open top frame having a partial front wall, two parallel partial side walls, and a bottom wall, but having no top or back wall, said frame adapted to be disposed on a supporting surface and further adapted to receive and support the carton of cylindrical containers so that an open end of the carton is tilted downwardly toward the supporting surface and the cylindrical containers are disposed horizontally and are free to roll towards the open end of the carton; and a dispenser pocket extending outwardly from the frame at the end closest to the supporting surface, the dispenser pocket having an opening on top communicating with the open end of the carton to receive successive cylindrical containers from the carton as prior containers are removed from the opening on top of the dispenser pocket.

2. The holder of claim 1, in which the frame includes a partial front wall adjacent the open end of the carton to prevent cylindrical containers from jamming up in the dispensing pocket.

3. The holder of claim 2, in which the dispenser pocket includes an upwardly facing opening from which the containers are removed.

4. The holder of claim 1, in which the frame of the holder comprises:

a base for receiving a side of the multi-pack carton;

a dispensing pocket having an upwardly facing dispensing opening, said dispensing pocket being defined by a forward extension of said base and a pair of side walls;

a front wall disposed adjacent and above the dispensing opening for receiving the open end of the carton and to limit the flow of cylindrical containers into the dispensing pocket to one at a time;

first and second side walls for receiving the top and bottom of the carton, respectively; and an extension means attached to said base for raising the end of the carton opposite its open end to enable gravity flow of the cylindrical containers towards the open end of the carton and the dispensing pocket of the holder.

5. A gravity-feed holder for dispensing individual cylindrical containers directly from a multi-pack carton having an open end comprising:

a base for receiving a side of the multi-pack carton, said base having a forward extension and a dispensing opening adjacent the open end of the carton;

a front wall disposed adjacent and above the dispensing opening for confining the open end of the carton and to limit the flow of cylindrical containers into the dispensing opening to one at a time;

first and second side walls for receiving the top and bottom of the carton, respectively;

a dispensing pocket communicating with the dispensing opening of the base and the open end of the carton, the pocket having an upwardly facing opening from which to remove successive cylindrical containers from the carton, said dispensing pocket being defined by the forward extension of said base and the pair of side walls; and an extension means attached to said base for raising the end of the carton opposite its open end to enable gravity flow of the cylindrical containers towards the open end of the carton and into the dispensing pocket of the holder, said holder adapted to be disposed on a supporting surface and further adapted to receive and support a multi-pack carton of cylindrical containers so that the open end of the carton is tilted downwardly toward the supporting surface and the cylindrical containers are disposed horizontally and are free to roll towards the open end of the carton.

* * * * *